US006217302B1

(12) United States Patent
Sun et al.

(10) Patent No.: US 6,217,302 B1
(45) Date of Patent: Apr. 17, 2001

(54) FLOATING SEAL BIAS FOR REVERSE FUN PROTECTION IN SCROLL COMPRESSOR

(75) Inventors: Zili Sun; Carlos Zamudio, both of Arkadelphia; Jason Hugenroth, Hope; Greg Hahn; Thomas Barito, both of Arkadelphia, all of AR (US); James W. Bush, Skaneateles, NY (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/512,548

(22) Filed: Feb. 24, 2000

(51) Int. Cl.[7] ..... F03C 2/00
(52) U.S. Cl. ..... 418/55.4; 418/55.5; 418/57
(58) Field of Search ..... 418/55.4, 55.5, 418/57

(56) References Cited

U.S. PATENT DOCUMENTS

| | | | | |
|---|---|---|---|---|
| Re. 35,216 | * | 4/1996 | Anderson et al. | 418/57 |
| 5,102,316 | * | 4/1992 | Caillat et al. | 418/57 |
| 5,447,418 | * | 9/1995 | Takeda et al. | 418/57 |
| 5,462,419 | * | 10/1995 | Hill et al. | 418/55.6 |
| 5,469,716 | * | 11/1995 | Bass et al. | 418/97 |
| 5,489,198 | * | 2/1996 | Comparin et al. | 418/57 |
| 5,580,229 | * | 12/1996 | Beck et al. | 418/57 |
| 5,611,674 | * | 3/1997 | Bass et al. | 418/57 |
| 5,649,816 | * | 7/1997 | Wallis et al. | 418/55.1 |
| 6,017,205 | * | 1/2000 | Weatherston et al. | 418/55.6 |
| 6,146,119 | * | 11/2000 | Bush et al. | 418/55.4 |

FOREIGN PATENT DOCUMENTS

| | | | | |
|---|---|---|---|---|
| 5-157063 | * | 6/1993 | (JP) | 418/57 |
| 6-241177 | * | 8/1994 | (JP) | 418/57 |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor back pressure chamber seal protector is operable to prevent the seal from moving away from a separator plate during reverse rotation. During reverse rotation, a check valve associated with the seal communicates a higher pressure fluid into the back pressure chamber such that a low pressure from an intermediate pressure chamber will not pull the seal away from the separator plate. In this way, the seal is maintained in contact with the separator plate during reverse rotation.

8 Claims, 3 Drawing Sheets

FLOATING SEAL BIAS FOR REVERSE FUN PROTECTION IN SCROLL COMPRESSOR

BACKGROUND OF THE INVENTION

This invention relates to a scroll compressor having a floating seal which has a protection device which is actuated upon reverse rotation.

Scroll compressors are becoming increasingly popular for refrigerant compression applications. In a scroll compressor a first scroll member has a base and a generally spiral wrap extending from the base.

A second scroll member also has a base and a generally spiral wrap extending from its base. The wraps of the first and second scroll member interfit to define compression chambers. The second scroll member is caused to orbit relative to the first scroll member, and as the wraps orbit relative to each other, a refrigerant to be compressed is entrapped and moved toward a discharge port.

As the refrigerant is compressed, a force is created tending to separate the first and second scroll member. One technique utilized to address this separating force is a back pressure chamber. A back pressure chamber is defined by tapping a compressed fluid to a chamber defined by seals behind one of the first or second scroll members. The fluid in the chamber creates a force in opposition to the separating force. In one known type of scroll compressor, the first scroll member, known as the non-orbiting scroll, is axially moveable relative to the second scroll member. A seal is placed in the base of the non-orbiting scroll and defines the back pressure chamber. This seal also separates an inlet zone from a discharge pressure zone.

During normal operation the seal is biased into contact with another component in the scroll compressor. Typically, the seal is biased against a separator plate which defines a discharge pressure chamber above the non-orbiting scroll. The seal is moveable away from the separator plate wall to allow the discharge and suction pressure zones to communicate.

Scroll compressors are sometimes prone to operation in a reverse direction. When the scroll compressor is operated in a reverse direction, the refrigerant is drawn through the discharge port, into the compression chambers, and then outwardly through the suction port. Operation in reverse rotation is undesirable, and potentially detrimental to the scroll compressor.

In the prior art mentioned above, operation in the reverse rotation will typically draw the seal away from the separator plate wall, allowing the discharge and suction pressure zones to communicate. This is true since the fluid which is tapped to the back pressure chamber will be at a very low pressure during reverse rotation. The seal will thus be drawn away from the plate, allowing communication between the discharge and suction pressure zone. This is somewhat undesirable, as oil is allowed to enter the discharge port from the suction pressure zone. The oil is then pumped through the scrolls and out of the compressor through a suction tube. This can lead to a loss of oil within the scroll compressor.

It would be desirable to have a scroll compressor seal which is structured to prevent the communication of the suction and discharge pressure zones during reverse rotation.

SUMMARY OF THE INVENTION

In the disclosed embodiment of this invention, a seal is mounted in the base of the non-orbiting scroll. The seal is biased into contact with the separator plate to define a back pressure chamber. An intermediate pressure fluid is tapped to the back pressure chamber to create a back pressure force resisting a separating force. During normal operation, the seal is maintained in contact with the separator plate. At this position the seal also separates a discharge pressure zone radially inwardly of the seal from a suction pressure zone, which is radially outward of the seal.

Upon reverse rotation, the pressure at the intermediate pressure zone will drop dramatically. This low pressure will draw the seal downwardly away from the separator plate. In the prior art, when this occurred, the discharge pressure zone communicates with the suction pressure zone. Oil in the suction pressure zone enters the discharge pressure zone, and is then pumped out the compressor through a suction tube. As mentioned above, this is undesirable.

The present invention addresses this concern by providing a check valve working with the seal. The check valve prevents flow from the back pressure chamber through the seal in a direction towards the separator plate. However, during reverse rotation, the relatively high pressure in the suction zone will pass into the tap, moving through the check valve and into the back pressure chamber. In this way, the relatively high pressure fluid in the suction zone will move into the back pressure chamber, preventing movement of the seal downwardly away from the separator plate. The flow of a large amount of oil from the suction pressure zone into the discharge pressure zone is prevented. In embodiments, the check valve could be in the seal or in the non-orbiting scroll.

These and other features of the present invention can be best understood from the following specification and drawings, the following of which is a brief description.

DETAILED DESCRIPTION OF A PREFERRED EMBODIMENT

Figure 1:
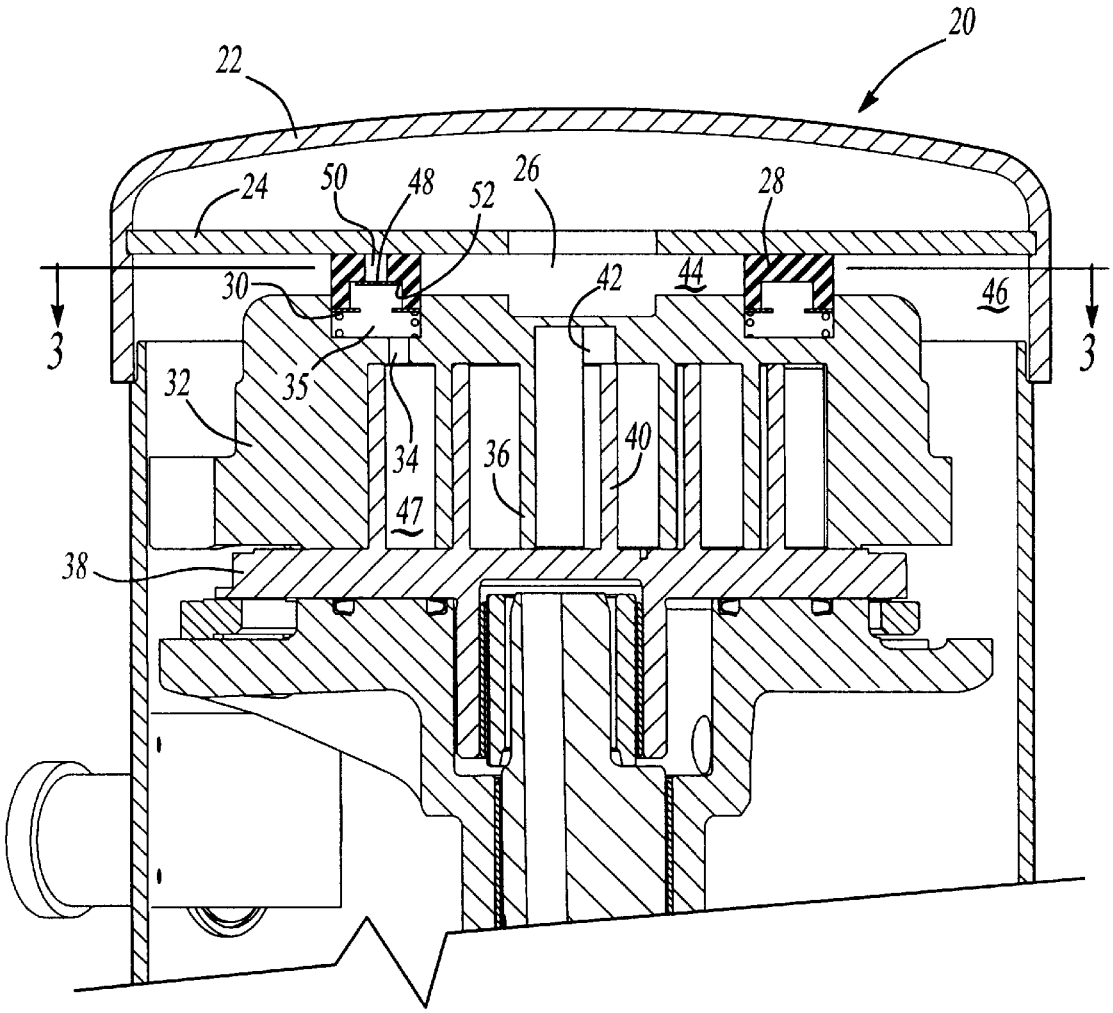
FIG. 1 shows a scroll compressor incorporating the present invention in a first position.

A scroll compressor 20 illustrated in FIG. 1 incorporates a casing 22 having an internal separator plate 24. A discharge opening 26 is formed adjacent a central area in the separator plate 24. A seal 28 seals against plate 24, and is spring biased at 30 away from the base of a non-orbiting scroll 32. The non-orbiting scroll is axially moveable, and a intermediate compressed fluid is tapped through tap 34 into a back pressure chamber 35 defined forwardly of seal 28. A scroll wrap 36 is formed on the non-orbiting scroll 32 and an orbiting scroll 38 includes its own wrap 40 which interfits with the wrap 36, as known. A central discharge port 42 communicates with a discharge pressure zone 44. Seal 28 separates discharge pressure zone 44 from a suction pressure zone 46.

A check valve 48 is typically seated against seat 52, isolating tap 50 extending through the seal 28. As shown in FIG. 1, during normal operation, the pressure in tap 34 is high and valve 48 is held against valve seat 52. The spring 30 holds seal 28 against the separator plate 24 in combination with the pressure from tap 34. The zones 44 and 46 are maintained separate by the seal 28.

Figure 2:
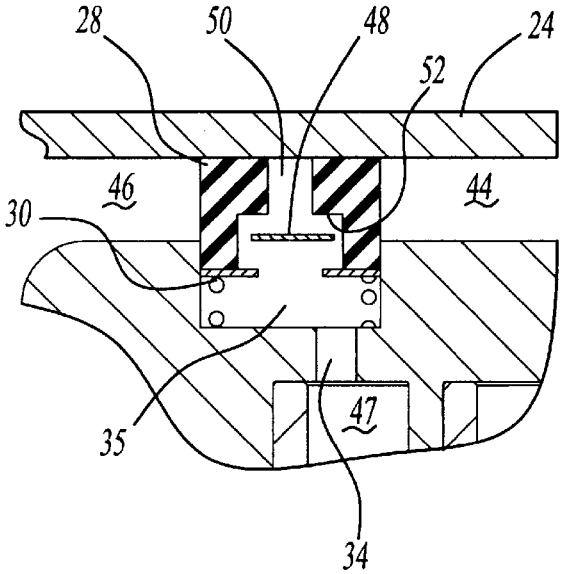
FIG. 2 shows a valve as part of the invention of FIG. 1 in a second position.

As shown in FIG. 2, when reverse rotation occurs, as may occur during shutdown of a scroll compressor, or if the motor is improperly wired, the pressure at the chamber 47 communicating with tap 34 drops dramatically. The low pressure from the compression chamber being communicated through tap 34 to chamber 35, will draw seal 28 downwardly away from the separator plate 24. This allows chambers 44 and 46 to communicate, which is described above as somewhat undesirable.

However, at the same time, the valve 48 moves away from the valve seat 52. The relatively high pressure in the zone 46 will move through the tap 50, and into the chamber 35. This relatively high pressure fluid will move back downwardly through the tap 34, but will also maintain the chamber 35 at a relatively high pressure, such that the force of the spring 30 will continue to hold seal 28 against the separator plate 24. In this way, the seal 28 will not move away from the separator plate to fully communicate chambers 44 and 46 during reverse running conditions. There might be some slight communication, however, in general, the two zones will be maintained separate. The oil will not flow between the chambers as was the case in the prior art.

Figure 3:
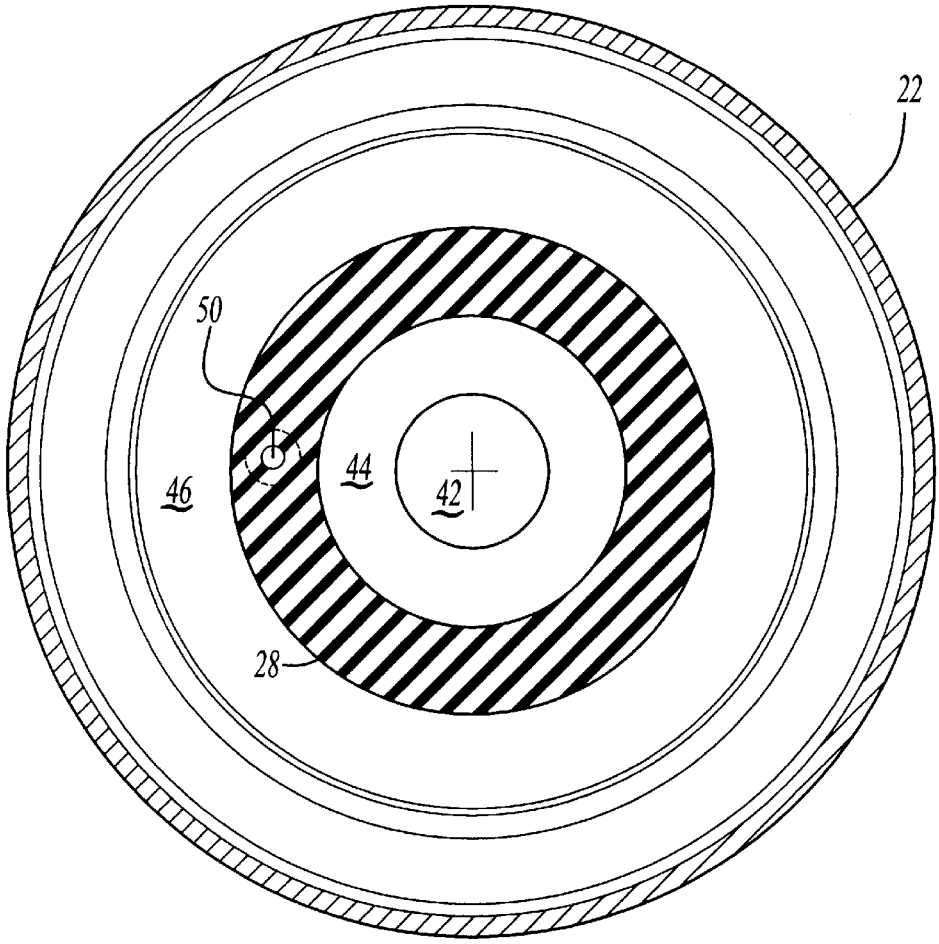
FIG. 3 is a top view of the inventive seal.

FIG. 3 is a top view of the seal 28 and tap 50.

Figure 4:
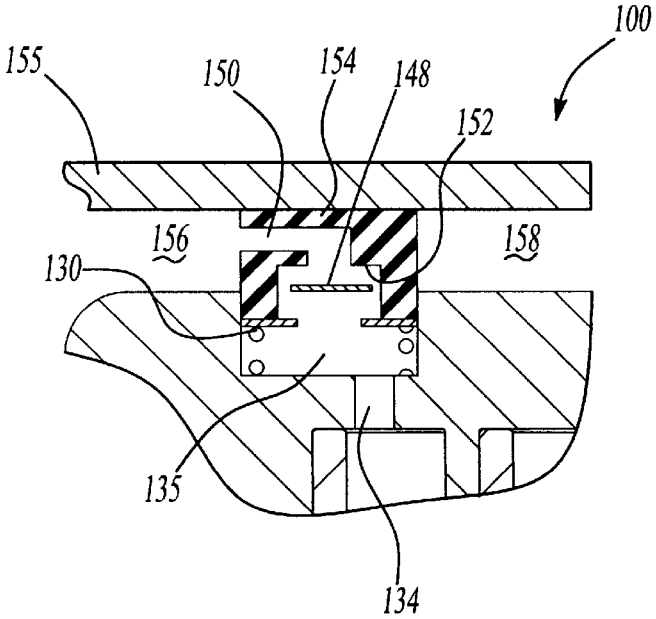
FIG. 4 shows an alternative embodiment.

FIG. 4 shows another embodiment 100, wherein a seal 130 is positioned above a chamber 135 communicating with the tap 134 to a compression chamber. The embodiment 100 is similar in operation to the earlier embodiment including the use of a spring and a check valve 148 moveable against a stop 152 to isolate a tap 150. However, the tap 150 in this embodiment extends radially outwardly of the seal, and the seal does have an upper wall 154 in contact with a separator plate 155. The tap 150 communicates with a suction pressure chamber 156. The seal also seals between the suction pressure chamber 156 and a discharge pressure chamber 158.

Figure 5:
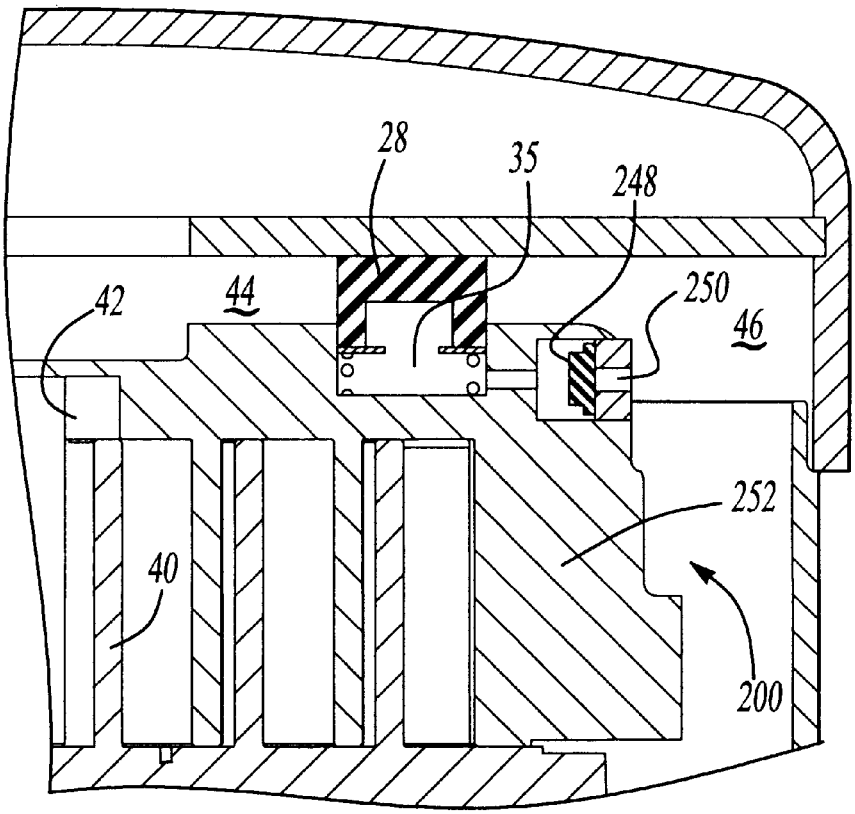
FIG. 5 shows another embodiment.

FIG. 5 shows another embodiment 200, wherein the check valve 248 is associated with a tap 250 in the base of the non-orbiting scroll 252. This embodiment will control flow of suction pressure fluid into the back pressure chamber 35 similar to the earlier embodiments. For purposes of this application, all three embodiments include check valves which are associated with the back pressure seal to control flow. The first two embodiments have the check valves mounted within the seal, and this third embodiment has its check valve mounted within the non-orbiting scroll.

Although a preferred embodiment of this invention has been disclosed, a worker in this art would recognize that certain modifications come within the scope of this invention. For that reason, the following claims should be studied to determine the true scope and content of this invention.

What is claimed is:

1. The scroll compressor comprising:

a first scroll member having a base and a generally spiral wrap extending from said base;

a second scroll member having a base and generally spiral wrap extending from said base, said wraps of said first and second scroll members interfitting to define compression chambers, said second scroll member being driven to orbit in a first direction relative to said first scroll member;

a housing receiving said first and second scroll members;

said base of said first scroll member including a discharge port, and said first scroll member being moveable axially along an orbit axis of said second scroll member; and a back pressure chamber formed on an opposed side of said base of said first scroll member relative to said second scroll member, said back pressure chamber communicating with a source of compressed fluid, said back pressure chamber defined by an axially moveable seal, said axially moveable seal being moveable within said back pressure chamber and against another component in said scroll compressor, said back pressure seal being biased toward said other component, and said back pressure seal further being associated with a check valve for blocking flow from said back pressure chamber outwardly of said back pressure chamber, but said check valve allowing flow into said back pressure chamber.

2. A scroll compressor as recited in claim 1, wherein said back pressure seal defines a discharge pressure zone radially inwardly of said seal, and a suction pressure zone radially outwardly of said seal; and refrigerant from one of said suction and discharge pressure zones moving said check valve and into said back pressure zone if said scroll compressor is operated in a direction reverse to said first direction.

3. The scroll compressor is recited in claim 1, wherein said other component is a separator plate positioned above said base of said first scroll member.

4. A scroll compressor as recited in claim 1, wherein said seal is provided with a spring biasing it toward said other component.

5. A scroll compressor as recited in claim 1, wherein said check valve is mounted within said seal.

6. A scroll compressor as recited in claim 5, wherein a tap extends through said seal from a surface adjacent said other component into said back pressure chamber, and said check valve selectively closing said tap.

7. A scroll compressor as recited in claim 5, wherein a tap extends from a radially outer surface of said seal into said back pressure chamber, and said check valve selectively closing said tap.

8. A scroll compressor as recited in claim 1, wherein said check valve is mounted within said base of said first scroll member.

* * * * *

UNITED STATES PATENT AND TRADEMARK OFFICE

CERTIFICATE OF CORRECTION

PATENT NO. : 6,217,302 B1
DATED : April 17, 2001
INVENTOR(S) : Sun et al.

It is certified that error appears in the above-identified patent and that said Letters Patent is hereby corrected as shown below:

Title page,
Item [54], should read -- [54] FLOATING SEAL BIAS FOR REVERSE RUN PROTECTION IN SCROLL COMPRESSOR --

Signed and Sealed this

Fourth Day of February, 2003

JAMES E. ROGAN
*Director of the United States Patent and Trademark Office*